US009935378B2

(12) United States Patent
Camacho et al.

(10) Patent No.: US 9,935,378 B2
(45) Date of Patent: Apr. 3, 2018

(54) ANTENNA APPARATUS CONFIGURED TO REDUCE RADIO-FREQUENCY EXPOSURE

(71) Applicant: TYCO ELECTRONICS CORPORATION, Berwyn, PA (US)

(72) Inventors: Eduardo Lopez Camacho, Watsonville, CA (US); Bruce Foster Bishop, Aptos, CA (US)

(73) Assignee: TE Connectivity Corporation, Berwyn, PA (US)

( * ) Notice: Subject to any disclaimer, the term of this patent is extended or adjusted under 35 U.S.C. 154(b) by 217 days.

(21) Appl. No.: 14/928,216

(22) Filed: Oct. 30, 2015

(65) Prior Publication Data

US 2017/0125916 A1 May 4, 2017

(51) Int. Cl.

| | |
|---|---|
| ***H01Q 1/24*** | (2006.01) |
| ***H01Q 19/00*** | (2006.01) |
| ***H01Q 1/22*** | (2006.01) |
| ***H01Q 19/10*** | (2006.01) |
| ***H01Q 1/48*** | (2006.01) |
| ***H01Q 5/371*** | (2015.01) |
| ***H01Q 5/378*** | (2015.01) |
| ***H01Q 1/38*** | (2006.01) |
| ***H01Q 5/364*** | (2015.01) |

(52) U.S. Cl.

CPC ..... *H01Q 19/005* (2013.01); *H01Q 1/2266* (2013.01); *H01Q 1/38* (2013.01); *H01Q 1/48* (2013.01); *H01Q 5/364* (2015.01); *H01Q 5/371* (2015.01); *H01Q 5/378* (2015.01); *H01Q 19/10* (2013.01)

(58) Field of Classification Search

CPC ..... H01Q 1/24; H01Q 19/005; H01Q 5/371; H01Q 1/48

USPC ..... 343/702

See application file for complete search history.

(56) References Cited

U.S. PATENT DOCUMENTS

| | | | | |
|---|---|---|---|---|
| 6,346,921 | B1 * | 2/2002 | Excell | H01Q 9/18 343/792.5 |
| 8,022,887 | B1 * | 9/2011 | Zarnaghi | H01Q 1/38 343/700 MS |
| 2004/0061652 | A1 * | 4/2004 | Ishihara | H01Q 9/0421 343/752 |
| 2005/0285795 | A1 * | 12/2005 | Puente Baliarda | H01Q 1/36 343/700 MS |
| 2017/0207529 | A1 * | 7/2017 | Maruyama | H01Q 3/24 |

* cited by examiner

*Primary Examiner* — Huedung Mancuso

(57) ABSTRACT

Antenna apparatus includes a system ground and an antenna sub-assembly including a feed pad and a ground pad that are configured to have a cable terminated thereto. The ground pad is electrically coupled to the system ground. The antenna sub-assembly includes a first level having a radiating trace that is electrically coupled to the feed pad. The radiating trace is configured for communication within a designated radio frequency (RF) band. The antenna sub-assembly also includes a second level that is stacked with respect to the first level and has a reflector. The reflector is vertically aligned with a portion of the radiating trace to block RF emissions therefrom.

20 Claims, 6 Drawing Sheets

ANTENNA APPARATUS CONFIGURED TO REDUCE RADIO-FREQUENCY EXPOSURE

BACKGROUND

The subject matter relates generally to wireless communication devices and to antenna assemblies or apparatuses that may be used by wireless communication devices and that are configured to reduce or re-direct radiation to lower the specific absorption rate (SAR).

Wireless communication devices are increasingly used by consumers and have an expanding number of applications within a variety of industries. Examples of such wireless devices include mobile phones, tablet computers, notebook computers, laptop computers, and handsets. These devices often include one or more integrated antennas that allow for wireless communication within a communication network. Recently, there have been two conflicting market demands for wireless devices. Users generally demand wireless devices that are smaller or weigh less, but the users also desire better performances and/or a greater number of capabilities. For example, wireless devices now operate within multiple frequency bands and are capable of selecting such bands for different networks. Features that have improved recently include data storage, battery life, and camera performance, among other things.

To provide smaller devices with improved performances and more capabilities, manufacturers have attempted to optimize the available space within the wireless device by resizing components of the wireless device or by moving the components to different locations. For example, the size and shape of the antenna may be reconfigured and/or the antenna may be moved to a different location. The number of available locations for an antenna, however, is limited not only by other components of the wireless device, but also by government regulations and/or industry requirements, such as those relating to SAR.

With respect to portable computers, such as laptops, notebooks, tablets, and convertible computers that can operate in laptop or tablet modes, antennas are positioned either within a section of the computer that includes a display or a base section that includes the keyboard. Regardless of the location, however, it is likely that an individual's body will be positioned adjacent to the antenna at some point. For example, individuals often place a portable computer on their laps or fold and grip convertible computers when in the tablet mode. Even at these moments, government and/or industry requirements require that the SAR does not exceed a predetermined level. Accordingly, antenna designs that reduce the amount of radio frequency (RF) exposure to the individual's body without significantly limiting performance are desired.

BRIEF DESCRIPTION

In an embodiment, an antenna apparatus is provided that includes a system ground and an antenna sub-assembly including a feed pad and a ground pad that are configured to have a cable terminated thereto. The ground pad is electrically coupled to the system ground. The antenna sub-assembly includes a first level having a radiating trace that is electrically coupled to the feed pad. The radiating trace is configured for communication within a designated radio frequency (RF) band. The antenna sub-assembly also includes a second level that is stacked with respect to the first level and has a reflector. The reflector is vertically aligned with a portion of the radiating trace to block RF emissions therefrom.

In an embodiment, an antenna apparatus is provided that includes a system ground and an antenna sub-assembly including a feed pad and a ground pad that are configured to have a cable terminated thereto. The ground pad is electrically coupled to the system ground. The antenna sub-assembly includes a first level having a radiating trace that is electrically coupled to the feed pad. The radiating trace is configured for communication within a designated radio frequency (RF) band. The antenna sub-assembly also includes a second level that is stacked with respect to the first level and includes a director. The director is configured to re-direct emitted RF energy and is electrically coupled to the system ground.

In an embodiment, a wireless communication device is provided that includes first and second device sections having respective edges that are rotatably coupled to each other. The wireless communication device also includes an antenna apparatus that is positioned within the first device section. The antenna apparatus includes a system ground and an antenna sub-assembly having a feed pad and a ground pad that are configured to have a cable terminated thereto. The ground pad being electrically coupled to the system ground. The antenna sub-assembly includes a first level having a radiating trace that is electrically coupled to the feed pad. The radiating trace is configured for communication within a designated radio frequency (RF) band. The antenna sub-assembly also includes a second level that is stacked with respect to the first level and has a reflector. The reflector is vertically aligned with a portion of the radiating trace to block RF emissions therefrom.

DETAILED DESCRIPTION

Figure 1:
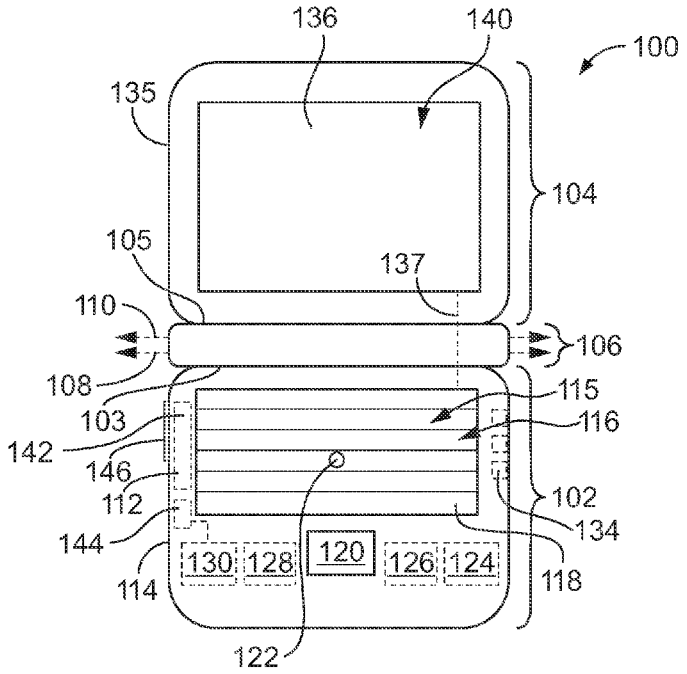
FIG. 1 is a schematic illustration of a wireless communication device formed in accordance with an embodiment.

Embodiments set forth herein include antenna apparatuses and wireless communication devices having antenna apparatuses that are configured to reduce exposure of radio frequency (RF) emissions to individuals. A wireless communication device is hereinafter referred to as a wireless device. In some embodiments, the antenna apparatus is integrated with a designated section of the wireless device. For example, the wireless device may be a portable computer having one or more sections that may come in contact with an individual. As used herein, a "portable computer" includes a laptop computer, a notebook computer, a tablet computer, and the like. In particular embodiments, the portable computer is similar to a laptop or notebook computer and is capable of being converted into a tablet-like computer. In other embodiments, the portable computer is a laptop or notebook computer. The portable computer may have discrete movable sections. For instance, the portable computer may include a base section having, among other things, a keyboard. The portable computer may also include a display section that includes, among other things, a display (e.g., touchscreen). The base and display sections may be rotatably coupled to one another. The antenna apparatus may be held by at least one of the base section or the display section.

The antenna apparatus may include a system or device ground and an antenna sub-assembly that is electrically coupled to the system ground. In some embodiments, the system ground has an area that is significantly larger than the antenna sub-assembly. The system ground may be, for example, one or more sheets of conductive metal. The system ground may be electrically coupled to other elements of the wireless device, such as a housing of a portable computer. As described herein, the antenna sub-assembly may include a plurality of levels or layers in which at least one of the levels or layers has one or more radiating traces capable of communicating at a designated RF frequency or band. The antenna sub-assembly may also include one or more reflectors, one or more directors, and one or more parasitic traces that are positioned relative to the radiating traces to reduce RF exposure. In particular embodiments, the wireless device may include a power-control circuit that reduces electrical power to the antenna apparatus when, for example, the wireless device senses that an individual's body is adjacent to the antenna apparatus.

In some embodiments, the antenna apparatus may function as a multi-band antenna that includes at least two frequency bands, such as 704-960 MHz, 1425-1850 MHz, and 1850-2700 MHz. In other embodiments, the antenna apparatuses may operate at other frequency bands, such as those that include about 5.3 GHz and/or 5.8 GHz. It should be understood that wireless devices and antenna apparatuses described herein are not limited to particular frequency bands and other frequency bands may be used. As used herein, two frequency bands may be "different" if the two frequency bands do not overlap or partially overlap.

One or more of the electrically conductive elements that form the antenna apparatus may comprise a metamaterial. The propagation of electromagnetic waves in most materials obeys the right-hand rule for the (E, H, β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E, H, β) vector fields follow the left-hand rule. Metamaterials that support only a negative index of refraction with permittivity ∈ and permeability μ being simultaneously negative are pure "left handed (LH)" metamaterials. Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies.

Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004). CRLH metamaterials can be structured and engineered to exhibit electromagnetic properties that are tailored for specific applications and can be used in applications where it may be difficult, impractical, or infeasible to use other materials. In addition, CRLH metamaterials may be used to develop new applications and to construct new devices that may not be possible with RH materials.

MTM structures can be used to construct antennas, transmission lines, and other RF components and devices, allowing for a wide range of technology advancements such as functionality enhancements, size reduction, and performance improvements. An MTM structure has one or more MTM unit cells. The equivalent circuit for an MTM unit cell includes a right-handed series inductance LR, a right-handed shunt capacitance CR, a left-handed series capacitance CL, and a left-handed shunt inductance LL. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the left-handed LH mode. In general, the LH mode helps excite and better match the low frequency resonances as well as improves the matching of high frequency resonances. The MTM antenna structures can be configured to support one or more frequency bands and a supported frequency band can include one or more antenna frequency resonances. For example, MTM antenna structures can be structured to support multiple frequency bands including a "low band" and a "high band." The low band includes at least one LH mode resonance and the high band includes at least one right-handed RH mode resonance associated with the antenna signal.

MTM antenna structures can be fabricated by using a conventional FR-4 Printed Circuit Board (PCB) or a Flexible Printed Circuit (FPC) board. Examples of other fabrication techniques include thin film fabrication technique, system on chip (SOC) technique, low temperature co-fired ceramic (LTCC) technique, and monolithic microwave integrated circuit (MMIC) technique.

FIG. 1 is a schematic illustration of a wireless communication device 100 formed in accordance with an embodiment. The wireless communication device 100 is hereinafter referred to as a wireless device. In an exemplary embodiment, the wireless device 100 is a convertible portable computer that is capable of being repositioned to operate in different modes or states. For example, the wireless device 100 may operate as a portable computer (e.g., laptop, notebook, and the like) in a first configuration and operate as a tablet computer in a second configuration. In other embodiments, however, the wireless device 100 may only have one configuration. For example, the wireless device 100 may only operate as a portable computer or only operate as a tablet computer. Yet in other embodiments, the wireless device may be a mobile phone or a wearable device (e.g., watch, fitness tracker, health status monitor, and the like). The wearable device may be integrated with other wearable elements, such as clothing.

The wireless device 100 may include multiple interconnected sections that are movable with respect to each other. In an exemplary embodiment, the wireless device 100 includes a first device section 102 and a second device section 104 that are interconnected to each other through a hinge assembly 106. The first device section 102 has a first edge 103, and the second device section has a second edge 105. The hinge assembly 106 may interconnect the first and second edges 103, 105 and permit the first and second device sections 102, 104 to move between a closed state and an operating state. In the illustrated embodiment, the hinge assembly 106 is a floating hinge that is capable of rotating about two axes of rotation. For example, the hinge assembly 106 may be rotatably coupled to the first device section 102 along a first axis of rotation 108 and rotatably coupled to the second device section 104 along a second axis of rotation 110. As such, the hinge assembly 106 and the first device section 102 are rotatable or pivotable about the first axis 108, and the hinge assembly 106 and the second device section 104 are rotatable or pivotable about the second axis 110. It should be understood, however, that embodiments set forth herein are not limited to wireless devices having hinge assemblies with floating hinges. For example, the hinge assembly 106 may only have one axis of rotation.

In particular embodiments, the first device section 102 includes an integrated antenna apparatus 112. In other embodiments, however, the second device section may include the antenna apparatus 112, or each of the first and second device sections 102, 104 may include a portion of the antenna apparatus 112. In an exemplary embodiment, the antenna apparatus 112 includes an antenna sub-assembly 142 that has one or more levels with antenna elements configured for wireless communication. In the illustrated embodiment, the antenna sub-assembly 142 includes a printed circuit, such as a PCB or flex circuit, that is manufactured to have the antenna structure described herein. For example, the printed circuit may include conductive traces and pads, which form a portion of the antenna that communicates wirelessly, that are supported by the dielectric layers of the printed circuit. In other embodiments, however, the antenna sub-assembly 142 may include a dielectric housing (e.g., molded housing) and conductive traces and pads formed in other manners as described below. In particular embodiments, the conductive elements include metamaterial.

Figure 3:
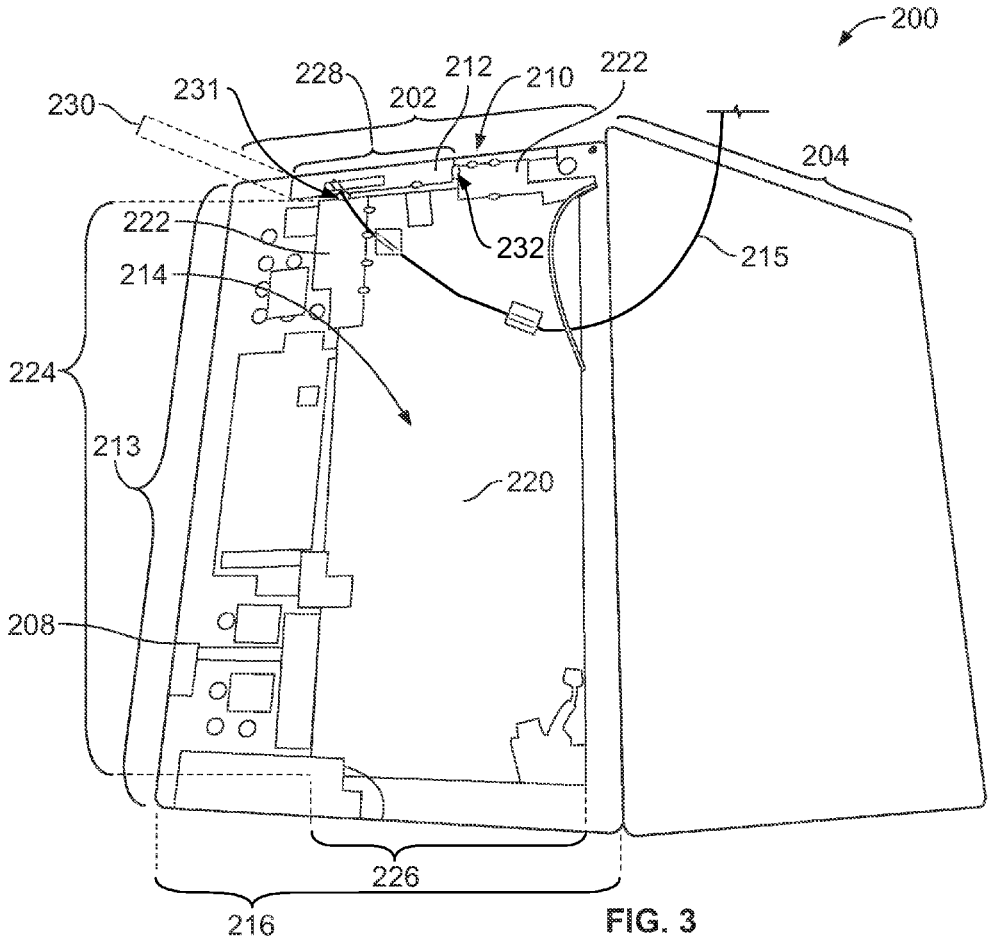
FIG. 3 is a bottom perspective view of a portable computer in which a portion of the base section is exposed to show an antenna apparatus formed in accordance with an embodiment.

The antenna apparatus 112 may also include a system ground (not shown), such as the system ground 214 (shown in FIG. 3). The antenna sub-assembly 142 is electrically coupled to the system ground. In other embodiments, however, it is contemplated that the antenna apparatus 112 may not be part of an antenna sub-assembly. Instead, the antenna elements may include, for example, stamped sections of sheet metal that are positioned relative to each other as described with respect to the antenna sub-assembly 142.

The first device section 102 may include a base housing 114 having an interactive side 115 that includes a user interface 116. The user interface 116 may include one or more input devices. For example, the user interface 116 includes a keyboard 118, a touchpad 120, and a tracking button 122 that are communicatively coupled to the internal circuitry of the wireless device. Each of the keyboard 118, the touchpad 120, and the tracking button 122 is an input device that is configured to receive user inputs from a user of the wireless device 100.

The base housing 114 surrounds and protects at least some circuitry of the wireless device 100. For example, the internal circuitry may include a processor 124 (e.g., central processing unit), memory 126, internal storage 128 (e.g., hard drive or solid state drive), and a power supply 130, and a cooling fan 132. The first device section 102 may also include a number of ports 134 that allow other devices or networks to communicatively couple to the wireless device 100. Non-limiting examples of external devices include removable media drives, external keyboards, a mouse, speakers, and cables (e.g., Ethernet cable). Although not shown, the first device section 102 may also be configured to be mounted to a docking station and/or charging station.

The second device section 104 includes a device housing 135 having an interactive side 140. The device housing 135 surrounds and protects at least some circuitry of the wireless device 100. For example, the second device section 104 includes a user display 136. The user display 136 is communicatively coupled to, for example, the processor 124 through circuitry (e.g., conductive pathways) 137. As used herein, the term "communicatively coupled" means coupled in a manner that allows direct or indirect communication of data signals between the two components that are communicatively coupled. For example, data signals may travel between the user display 136 and the processor 124 through the circuitry 137. However, the data signals may be processed or modified at some point between the user display 136 and the processor 124.

In an exemplary embodiment, the user display 136 is a touchscreen that is capable of detecting a touch from a user and identifying a location of the touch within the display area. The touch may be from a user's finger and/or a stylus or other object. The user display 136 may implement one or more touchscreen technologies. For example, the user display 136 may include a resistive touchscreen having a plurality of layers, including electrically-resistive layers. The user display 136 may include a surface acoustic wave (SAW) touchscreen that utilizes ultrasonic waves for identifying touches. The user display 136 may also be a capacitive touchscreen based on one or more known technologies (e.g., surface capacitance, projected capacitive touch (PCT), mutual capacitance, or self-capacitance). The user display 136 may include an optical touchscreen that is based on optical technology (e.g., image sensors and light sources). Other examples of touchscreen technology may include acoustic pulse recognition touchscreens and dispersive signal technology. In other embodiments, however, the user display 136 is not a touchscreen that is capable of identifying touches. For example, the user display 136 may only be capable of displaying images.

Optionally, the second device section 104 may include additional components, such as one or more of the components located within the first device section 102. Although not shown, the second device section 104 may also include ports, speakers, integrated cameras, etc. It should be understood that the wireless device 100 is only described as one example and that embodiments may include other types of wireless devices. For example, the wireless device may be a flip phone.

The antenna apparatus 112 is communicatively coupled to the processor 124. For example, the antenna apparatus 112 may be coupled to an RF module (e.g., transmitter/receiver) that decodes the signals received from the antenna apparatus 112 and/or encodes the signals received from the processor 124. During operation of the wireless device 100, the wireless device 100 may communicate with external devices or networks through the antenna apparatus 112. To this end, the antenna apparatus 112 may include antenna elements that are configured to exhibit electromagnetic properties that are tailored for desired applications. For instance, the antenna apparatus 112 may be configured to operate in multiple frequency bands simultaneously. The structure of the antenna apparatus 112 can be configured to effectively operate in particular radio bands. The structure of the antenna apparatus 112 can be configured to remotely select specific radio bands for different networks. The antenna apparatus 112 may be configured to have designated properties, such as a voltage standing wave ratio (VSWR), gain, bandwidth, and a radiation pattern of the antenna.

The wireless device 100 may also include a power-control circuit 144 and one or more proximity sensors 146 that are configured to detect when an individual's body, including skin or clothing, is adjacent to the wireless device 100. For example, the proximity sensors 146 may be infrared (IR) sensors or capacitive sensors that detect when an individual's skin is within a certain distance from the antenna apparatus 112 and/or one or more sections of the wireless device 100, such as the first or second device sections 102, 104. As shown, the proximity sensor 146 is illustrated as a simple block, like other circuitry. It should be understood, however, that the proximity sensors 146 may have any structure in accordance with the type of proximity sensor. The proximity sensor 146 is communicatively coupled to the power-control circuit 144 that, in turn, is communicatively coupled to the antenna apparatus 112. More specifically, the power-control circuit 144 is capable of reducing power to the antenna apparatus 112 in order to reduce RF emissions. In some embodiments, the power reduction may be localized to certain spaces and/or applied to only a select number of the available frequency bands.

Embodiments set forth herein may be configured to achieve designated SAR limits. In particular, the antenna apparatus and/or power-control circuit may be configured to achieve designated SAR limits. SAR is a measure of the rate that RF energy is absorbed by a body. In some cases, an allowable SAR limit from wireless devices is 1.6 watts per kilogram (W/kg), as averaged over one gram of tissue. However, the SAR limit may change based upon application of the wireless device, government regulations, industry standards, and/or future research regarding RF exposure. In particular embodiments, the antenna apparatus and/or power-control circuit are configured for zero clearance when an individual's body is determined to be adjacent to a designated area of the wireless device, such as the antenna apparatus.

The SAR limits may depend upon the application of the wireless device. The SAR for one or more embodiments may be determined in accordance with one or more protocols, such as those provided by industry and/or government agencies. By way of example, embodiments set forth herein may be tested and/or configured to satisfy the SAR-related standards set forth by the U.S. Federal Communications Commission (FCC).

Figure 2:
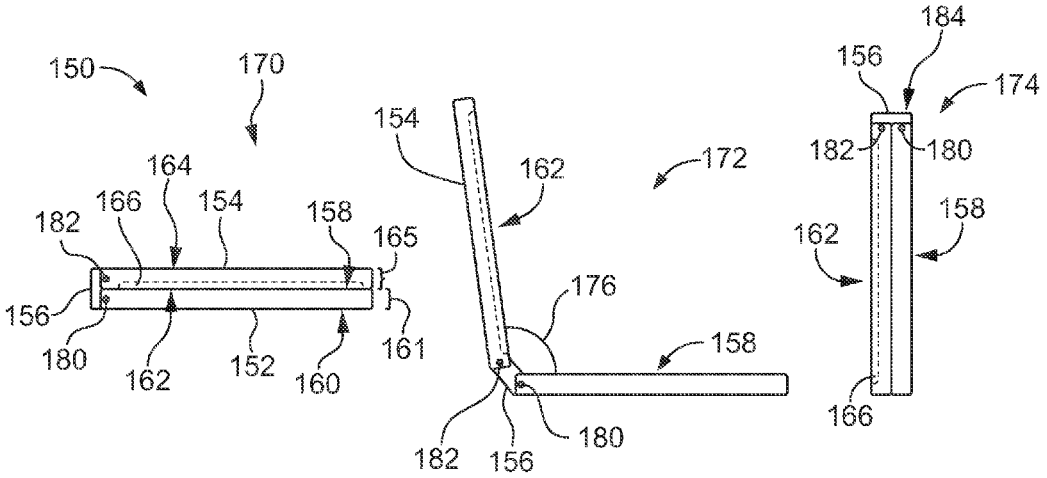
FIG. 2 shows three side views of a wireless communication device formed in accordance with an embodiment that illustrate three different operative states of the wireless communication device.

FIG. 2 shows three side views of a wireless device 150 formed in accordance with an embodiment. More specifically, FIG. 2 shows the wireless device 150 in a closed state or mode 170, a first operating state or mode 172, and a second operating state or mode 174. The wireless device 150 may be similar or identical to the wireless device 100 (FIG. 1). With respect to the closed state 170, the wireless device 150 includes a first device section 152, a second device section 154, and a hinge assembly 156 that movably couples the first and second device sections 152, 154. The first device section 152 includes an interactive side 158 and a housing side 160. The interactive side 158 and the housing side 160 face in opposite directions with a thickness 161 of the first device section 152 extending therebetween. The interactive side 158 is configured to receive user inputs and/or provide outputs to the user. The outputs may be in the form of audio signals (or sound) or video signals (or images). The interactive side 158 may include one or more input devices, such as a keyboard, touchpad, and/or tracking button (not shown).

The second device section 154 may include an interactive side 162 and a housing side 164. The interactive side 162 and the housing side 164 face in opposite directions with a thickness 165 of the second device section 154 extending therebetween. The interactive side 162 includes a user display 166. The interactive side 162 may also include other components for receiving user inputs or providing outputs to a user.

In the closed state 170, the first and second device sections 152, 154 are positioned side-by-side. For example, the interactive sides 158, 162 may engage each other and/or have a nominal gap therebetween. The housing sides 160, 164 constitute exterior sides of the wireless device 100 when the wireless device 100 is in the closed state 170.

In the first operating state 172, the interactive sides 158, 162 define a non-orthogonal angle 176. The angle 176 is generally between 80°-150° during operation, but is not necessarily limited to this range. It should be understood that the first operating state is not limited to a single angle 176. For example, the angle 176 in the first operating state 172 may be any angle within a designated range of angles, such as greater than 60°. In the first operating state 172, the input devices (e.g., keyboard, touchpad, or tracking button) are active such that the input devices may be responsive to actions by the user. The first operating state 172 may be referred to as the computer mode, wherein the wireless device 100 functions in a similar manner as a conventional portable computer.

The hinge assembly 106 permits the first and second device sections 152, 154 to be folded from the first operating state 172 to the second operating state 174. In the second operating state 174, the first and second device sections 152, 154 are positioned side-by-side and the interactive sides 158, 162 face in opposite directions. The interactive sides 158, 162 may constitute exterior sides of the wireless device 100. As such, the user display 166 may be exposed to an exterior of the wireless device 100. The second operating state 174 may be referred to as the tablet mode, wherein the wireless device 150 functions in a similar manner as a conventional tablet computer. For example, the user display 166 may be a touchscreen that is configured to receive touches from a user of the wireless device 100. In the second operating state 174, the hinge assembly 156 may form or become a device edge 184 of the wireless device 150 that is configured to be gripped by a user.

In some embodiments, the input device(s) along the interactive side 158 may be inactive in the second operating state 174 such that the input devices may not be responsive to actions by the user. For example, the wireless device 150 may have one or more sensors that indicate the wireless device 150 is in the second operating state 174. The processor 124 may receive this information and deactivate the input devices. In other embodiments, however, the input devices along the interactive side 158 may be active in the second operating state 174.

As the wireless device 150 transitions between the different states, the hinge assembly 156 may move relative to the first device section 152 and/or the second device section 154. By way of illustration, the hinge assembly 156 may rotate about first and second axes of rotation 180, 182 as the second device section 154 is moved from the closed state 170 to the first operating state 172. As the second device section 154 transitions from the first operating state 172 to the second operating state 174, the hinge assembly 156 may rotate about the first and second axes 180, 182.

As described herein, at least one of the first and second device sections 152, 154 may include a portion of an antenna apparatus (not shown). The antenna apparatus may move relative to the first device section 152 and/or the second device section 154 as the wireless device 150 moves between the different states. Embodiments set forth here may be configured to reduce power to the antenna apparatus based on at least one of (a) the state or mode of the wireless device (e.g., closed, first operating, second operating); (b) whether an individual's body is adjacent to the antenna apparatus; (c) a distance that the individual's body is located away from the antenna apparatus; and (d) a predetermined radiation pattern of the antenna apparatus. For example, the antenna apparatus may be positioned closer to the housing side 160. In the first operating state, the housing side 160 is exposed to an exterior of the wireless device 150. In the second operating state, however, the interactive side 158 is exposed to an exterior of the wireless device 150. In such embodiments, power reduction may be greater in the first operating state than the second operating state.

FIG. 3 is a bottom perspective view of a portable computer 200 formed in accordance with an embodiment. The portable computer 200 may be similar to the wireless device 100 (FIG. 1) or the wireless device 150 (FIG. 2). The portable computer 200 includes a base section 202 and a display section 204. The base section 202 is exposed in FIG. 3 to show internal components of the portable computer 200. For example, the portable computer 200 includes an antenna apparatus 210 having an antenna sub-assembly 212 and a system ground 214. The system ground may also be referred to as a ground plate or ground plane. Also shown, a cable (e.g., coaxial cable) 215 is terminated to the antenna sub-assembly 212 at one end. Although not shown in FIG. 3, the cable 215 is communicatively coupled through the other end to other circuitry of the portable computer 200, such as a transmitter/receiver. The base section 202 has a housing 208 that determines exterior dimensions of the base section 202. More specifically, the housing 208 has a first dimension (or width) 213 and a second dimension (or depth) 216. Although not visible in FIG. 3, the housing 208 also has a third dimension (or height or thickness).

The system ground 214 includes a plurality of conductive elements, including a main section 220 and peripheral sections 222. The main section 220 and peripheral sections 222 are mechanically and electrically coupled to each other through, for example, soldering or welding. In the illustrated embodiment, each of the main section 220 and the peripheral sections 222 includes a respective metallic sheet or foil. The sections 220, 222 may include, for example, aluminum or copper. In other embodiments, the system ground 214 includes only one metallic sheet. The system ground 214 is configured to be electrically coupled to other components of the portable computer 200, such as the housing 208.

The system ground 214 and the antenna sub-assembly 212 are electrically coupled to one another. As shown, the system ground 214 and the antenna sub-assembly 212 are soldered to each other. However, other mechanisms for electrically coupling the system ground 214 and the antenna sub-assembly 212 may be used. For example, the two elements may be coupled through conductive tape or conductive clips (or spring clips). In the illustrated embodiment, the system ground 214 and the antenna sub-assembly 212 are electrically coupled at multiple terminating areas 231, 232. In other embodiments, however, the system ground 214 and the antenna sub-assembly 212 may be electrically coupled to each other at only a single terminating area. As shown, the system ground 214 has a surface area that is significantly greater than a surface area of the antenna sub-assembly 212. More specifically, the system ground 214 has a first dimension (or width) 224 and a second dimension (or depth) 226. The antenna sub-assembly 212 has a first dimension (or length) 228 and a second dimension (or width) 230. The area of the system ground 214 may be, for example, at least five times (5×) the area of the antenna sub-assembly 212, at least ten times (10×) the area of the antenna sub-assembly 212, at least fifteen times (15×) the area of the antenna sub-assembly 212, or more. In the illustrated embodiment, the system ground 214 and the antenna sub-assembly 212 do not substantially overlap each other. In other embodiments, however, the system ground 214 and the antenna sub-assembly 212 may substantially overlap each other.

Figure 4:
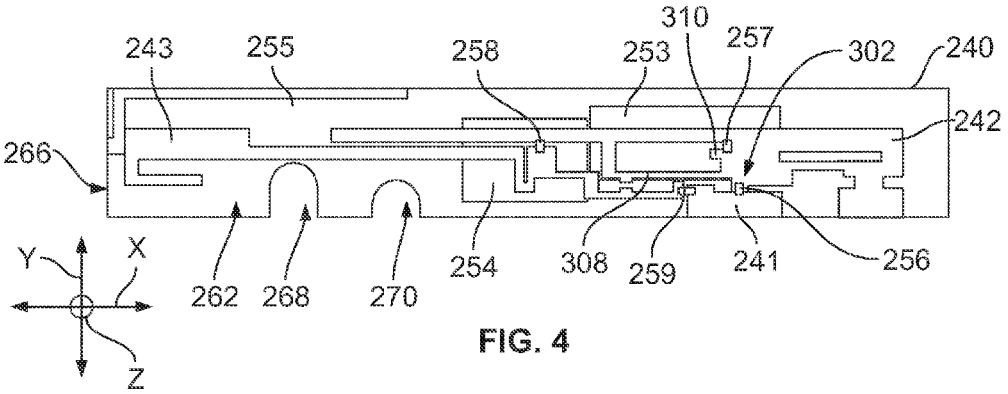
FIG. 4 is a plan view of an antenna sub-assembly of the antenna apparatus of FIG. 3.

FIG. 4 is a plan view of the antenna sub-assembly 212 that includes, in the illustrated embodiment, a portion of the antenna apparatus 210. The antenna sub-assembly 212 may be manufactured through a variety of fabrication technologies. For example, the antenna sub-assembly 212 may be manufactured through known printed circuit board (PCB) technologies. The antenna sub-assembly 212 for such embodiments may be a laminate or sandwich structure that includes a plurality of stacked substrate layers. Each substrate layer may include, at least partially, an insulating dielectric material. By way of example, the substrate layers may include a dielectric material (e.g., flame-retardant epoxy-woven glass board (FR4), FR408, polyimide, polyimide glass, polyester, epoxy-aramid, metals, and the like); a bonding material (e.g., acrylic adhesive, modified epoxy, phenolic butyral, pressure-sensitive adhesive (PSA), preimpregnated material, and the like); a conductive material that is disposed, deposited, or etched in a predetermined manner; or a combination of the above. The conductive material may be copper (or a copper-alloy), cupro-nickel, silver epoxy, conductive polymer, and the like. It should be understood that substrate layers may include sub-layers of, for example, bonding material, conductive material, and/or dielectric material.

It should be understood, however, that the antenna sub-assembly 210 may be manufactured through other methods. One or more elements of the antenna sub-assembly may be manufactured through laser direct structuring (LDS), two-shot molding (dielectric with copper traces), and/or ink-printing. For example, structural components may be manufactured by molding a dielectric material (e.g., thermoplastic) into a designated shape. Conductive elements (e.g., traces, reflectors, directors) may then be disposed on surfaces of the mold through, for example, ink-printing. Alternatively, conductive elements may be first formed and then a dielectric material may be molded around the conductive components. For example, the conductive elements may be stamped from sheet metal, disposed within a cavity, and then surrounded by a thermoplastic material that is injected into the cavity.

As shown, the antenna sub-assembly 212 is oriented with respect to mutually perpendicular X, Y, and Z-axes. The Z-axis extends into and out of the page. Conductive elements of the antenna sub-assembly 212, such as traces, reflectors, directors, etc., may overlap with each other in the antenna sub-assembly 212. As used herein, a conductive element "overlaps" with another conductive element if a line extending parallel to the Z-axis intersects both conductive elements. As set forth herein, conductive elements may overlap with each other to shield or reflect RF emissions and/or redirect RF energy in order to reduce RF exposure or SAR.

FIG. 4 is a view of a first level 240 having conductive elements 241, 242, and 243. The second level 250 (shown in FIG. 6) is positioned beneath the first level 240 with respect to the view of FIG. 4 and includes conductive elements 251 (FIG. 6), 252 (FIG. 6), 253, 254, and 255. Only conductive elements 253-255 are shown in FIG. 4. The antenna sub-assembly 212 also includes passive components, such as a first capacitor 256, a second capacitor 257, and a third capacitor 258 and an inductor 259. Also shown in FIG. 4, the antenna sub-assembly 212 has a circuit edge 266 that defines a perimeter of the antenna sub-assembly 212. The circuit edge 266 may define recesses 268, 270. The first and second levels 240, 250 extend along planes that are perpendicular to the Z-axis (FIG. 3) and have different elevations relative to the Z-axis. For embodiments that include substrate layers, two layers may be stacked with respect to each other along the Z-axis. As used herein, two layers are "stacked" with respect to each other if the layers directly interface with each other or have one or more intervening layers therebetween.

Figure 5:
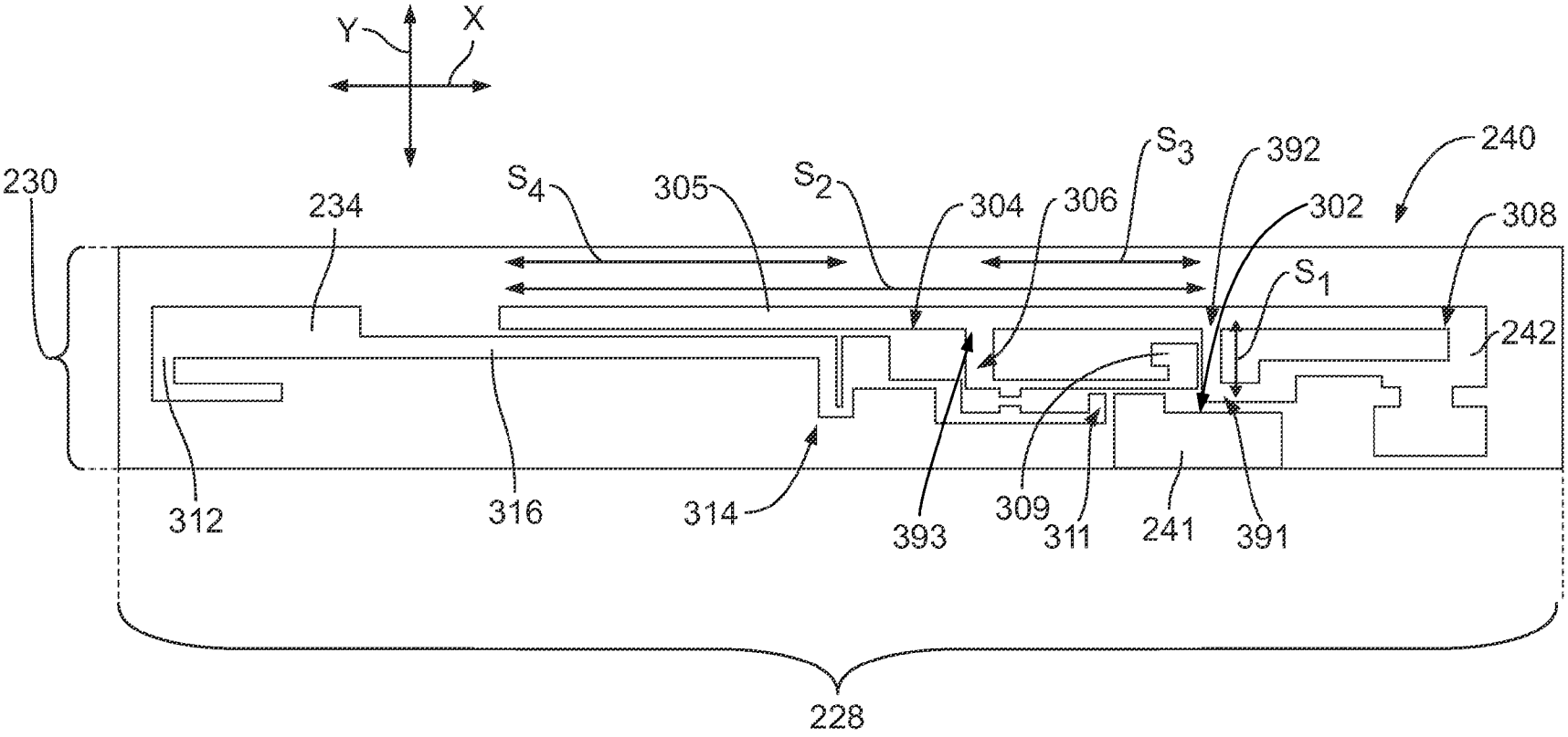
FIG. 5 is a plan view of a first level of the antenna sub-assembly of FIG. 4 illustrating conductive elements of the antenna sub-assembly.

FIG. 5 is a plan view of the first level 240. The conductive elements 241-243 are hereinafter referred to as the ground pad or trace 241, the radiating trace 242, and the parasitic trace 243. As shown, the ground pad 241, the radiating trace 242, and the parasitic trace 243 are discrete structures that are separated from each other. Gaps that separate the respective elements may be controlled to achieve a designated performance.

In an exemplary embodiment, the first dimension 228 is 99.00 millimeters (mm) and the second dimension 230 is 13.50 mm. In some embodiments, dimensions of the conductive elements 241-243 may be based on these values of the first and second dimensions 228, 230. For example, the value of dimension $S_2$ may be determined by using the first dimension 228 as a reference. Likewise, the dimensions of any gaps formed between the conductive elements 241-243 may be based on these values.

As shown, the radiating trace 242 includes a feed point or area 302. The radiating trace 242 may also include multiple branches or arms that are configured to resonate at a designated frequency band. For example, the radiating trace 242 includes a first branch (indicated by the arrow 304) that is configured to resonate at a frequency band of 698-960 MHz, a second branch (indicated by the arrow 306) that is configured to resonate at a frequency band of 1425-1990 MHz, and a third branch or loop (indicated by the arrow 308) that is configured to resonate at a frequency band of 2110-2700 MHz. It should be noted that the radiating trace 242 may be configured to resonate at different frequency bands than those described herein.

The first branch 304 extends a distance $S_1$ from the feed point 302 in direction that is parallel to the Y-axis and then extends a distance $S_2$ that is parallel to the X-axis. The portion of the first branch 304 that extends the distance $S_2$ is hereinafter referred to as a branch segment 305. Also shown, the second branch 306 extends the distance $S_1$ from the feed point 302 in direction that is parallel to the Y-axis, a distance $S_3$ that is parallel to the X-axis along the branch segment 306, and then forms a spiral or hook segment 308. The spiral or hook segment 308 has a designated length for achieving the predetermined frequency band.

The radiating trace 242 may have a plurality of high-emission areas or zones that provide a relatively high level of RF emissions. The high-emission areas or zones may be caused by current at the designated areas. For example, a first high-emission area 391 may exist proximate to the feed point 302, a second high-emission area 392 may exist proximate to a portion of the radiating trace 242 that joins the branch segments 304 and 308, and a third high-emission area 393 may exist proximate to a portion of the radiating trace 242 that joins the branch segments 304 and 306.

Briefly, with respect to FIG. 4, the feed point 302 is capacitively coupled to the ground pad 241 through the capacitor 256. In an exemplary embodiment, the capacitor 257 has a capacitance of 0.5 pF. Optionally, an end portion 310 of the spiral segment 308 is capacitively coupled to the branch segment 305. In an exemplary embodiment, the capacitor 257 has a capacitance of 0.5 pF. The branch segment 305 is also capacitively coupled to the parasitic trace 243 through the capacitor 258. In an exemplary embodiment, the capacitor 258 has a capacitance of 0.6 pF. The parasitic trace 243 is inductively coupled to the ground pad 241 through the inductor 259. In an exemplary embodiment, the inductance of the inductor 259 is 1.3 nH. However, it should be understood that embodiments are not limited to the capacitance values provided above. In other embodiments, one or more of the capacitors may be removed.

Returning to FIG. 5, the parasitic trace 243 has a non-linear path from a location 311 that is adjacent to the ground pad 241 to a distal end section 312 of the parasitic trace 243. The parasitic trace 243 has a meandering segment 314 that extends from the location 311 to a linear trace segment 316. The linear trace segment 316 extends from the meandering segment 314 to the distal end section 312. As shown, the parasitic trace 243 is configured such that trace segment 316 extends immediately adjacent to the branch segment 306 for a distance $S_4$. The parasitic trace 243 may capacitively couple to the branch segment 306 along the distance $S_4$.

The parasitic trace 243 is configured to modify a radiation pattern of the RF emissions from the radiating trace 242. For example, the parasitic trace 243 may be configured to direct the RF emissions in a designated direction and increase the directivity or gain of the antenna apparatus 210. The parasitic trace 243 may operate as a passive resonator that absorbs the RF waves from the radiating trace 242 and re-radiate the RF waves with a different phase.

Figure 6:
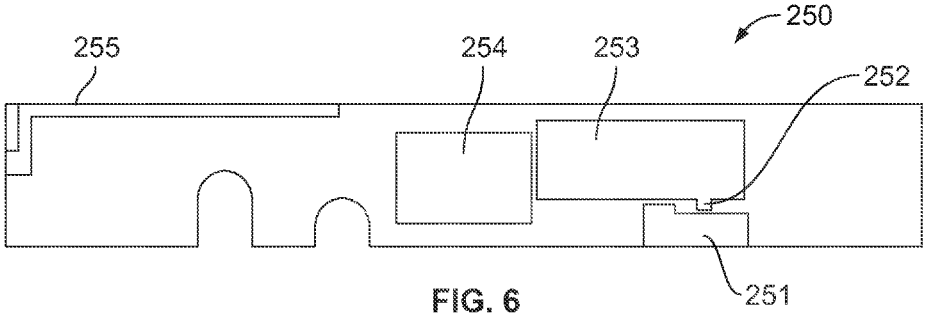
FIG. 6 is a plan view of a second level of the antenna sub-assembly of FIG. 4 illustrating additional conductive elements of the antenna sub-assembly.

FIG. 6 is a plan view of the second level 250. In some embodiments, the conductive elements 251-255 are configured to be exposed to an exterior of the antenna sub-assembly 212 (FIG. 3). The conductive elements 251-255 are hereinafter referred to as the ground pad or trace 251, a feed pad 252, a first reflector 253, a second reflector 254, and a director 255. In some embodiments, the first and second reflectors 253 and 254 may be joined such that a single reflector exists.

Figure 7:
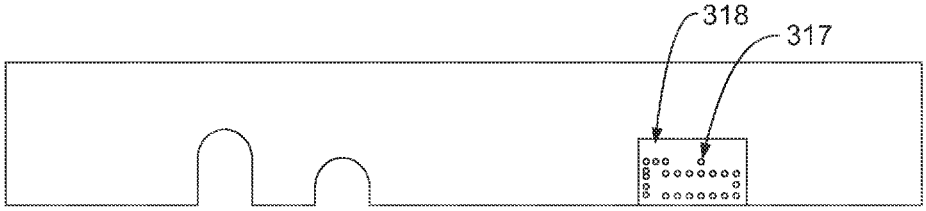
FIG. 7 is a plan view of a third level of the antenna sub-assembly of FIG. 4 illustrating vias that interconnect the conductive elements of the first level and a second level.

The feed pad 252 is electrically coupled to the feed point 302 (FIG. 5) through a via 317 (shown in FIG. 7). The feed pad 252 is configured to have a conductive pathway (e.g., the coaxial cable 215 (FIG. 3)) electrically coupled thereto for communicating radio-frequency (RF) waves. In some embodiments, the ground pad 251 is configured to have a shielding or ground layer of the cable 215 terminated thereto. The ground pad 251 is electrically coupled to the ground pad 241 (FIG. 5) through a plurality of vias 318 (shown in FIG. 7). In some embodiments, the ground pads 241, 251 have similar shapes and the vias 318 are evenly distributed along a perimeter of the ground pads 241, 251.

The first and second reflectors 253, 254 are positioned to align with the multiple high-emission areas 391-393 (FIG. 5). For example, the first reflector 253 may overlap with the high-emission areas 391, 392, and the second reflector 254 may overlap with the high-emission area 393. Optionally, the first reflector 253 may have an edge of that overlaps with the high-emission area 391. In either case, the first reflector 253 may be adjacent to the high-emission area 391 such that the RF emissions are blocked and/or re-directed. As used herein, a reflector "blocks" or "re-directs" RF emissions if only a portion of the RF emissions are blocked or re-directed. In other words, another portion or other portions of the RF emissions may escape or leak passed the reflectors. In some embodiments, the reflectors 253, 254 shield the exterior of the antenna sub-assembly 212 such that RF exposure or SAR is reduced. In some embodiments, the reflectors 253, 254 may function as passive components that capacitively couple to the radiating trace 242 and the parasitic trace 243.

The director 255 is configured to re-direct RF energy to effectively lower RF emissions that may be experienced in the exterior of the base section 202 (FIG. 3). In particular embodiments, the director 255 extends along the circuit edge 266 (FIG. 4) of the antenna sub-assembly 212. In particular embodiments, the director 255 is mechanically and electrically coupled to the system ground 214 (FIG. 3).

Figure 8:
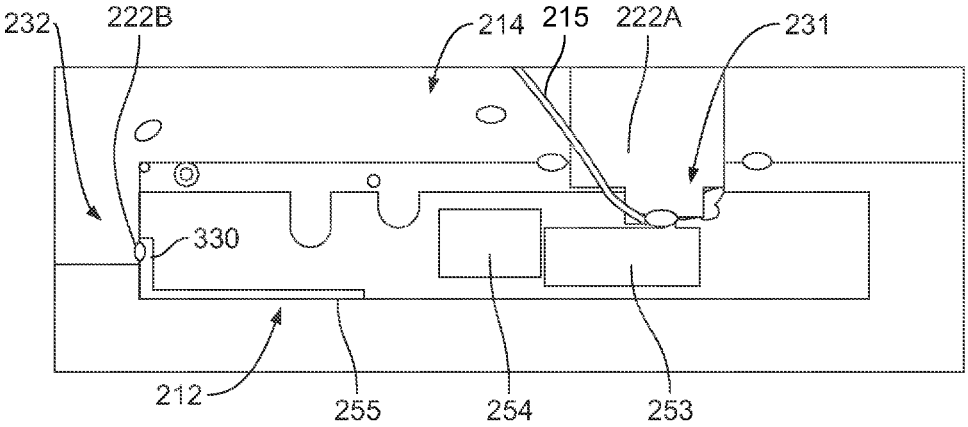
FIG. 8 illustrates the antenna sub-assembly and a system ground of the antenna apparatus of FIG. 3 electrically coupled to each other.

FIG. 8 illustrates the antenna sub-assembly 212 electrically coupled to the system ground 214 at the terminating area 231 and the terminating area 232. As shown, the second level 250, including the first and second reflectors 253, 254, is exposed to an exterior. At the terminating area 231, a wire conductor of the cable 215 is soldered to the feed pad 252 (not visible in FIG. 8) and a shielding element of the cable 215 is soldered to the ground pad 251 (not visible in FIG. 8). The ground pad 251 may also be soldered to the peripheral section 222A of the system ground 214. At the terminating area 232, an edge section 330 of the director 255 is soldered to the peripheral section 222B of the system ground 214. As such, the antenna sub-assembly 212 may be electrically grounded to the system ground 214 at two different areas.

Figure 9:
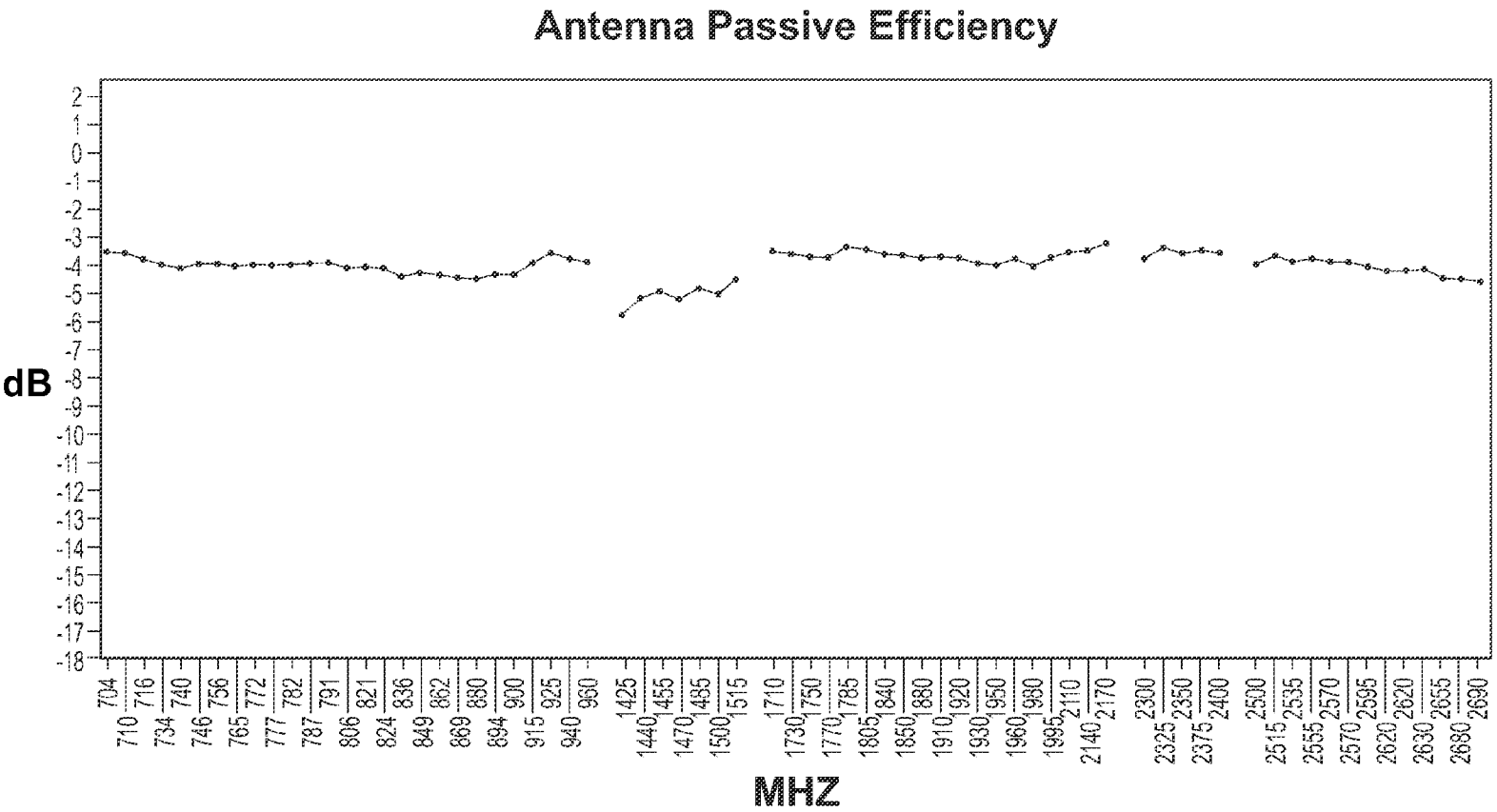
FIG. 9 is a graph illustrating a passive efficiency of an antenna apparatus formed in accordance with an embodiment.

FIG. 9 is a graph illustrating a passive efficiency by an antenna apparatus that was formed in accordance with an embodiment. More specifically, an antenna apparatus, such as the antenna apparatus 210 (FIG. 2), was tested through a range of frequencies with an input power of 24.0 dBm. The SAR (measured in W/kg) was significantly reduced compared to antenna assemblies that did not include the reflectors, directors, and parasitic traces. For example, at 1880 MHz, the passive efficiency was −4.4 dB prior to making the modifications described herein and −3.6 dB after making the modifications. This corresponded to about a 33% reduction in SAR (e.g., 5.57 W/kg compared to 3.7 W/kg).

Figure 10:
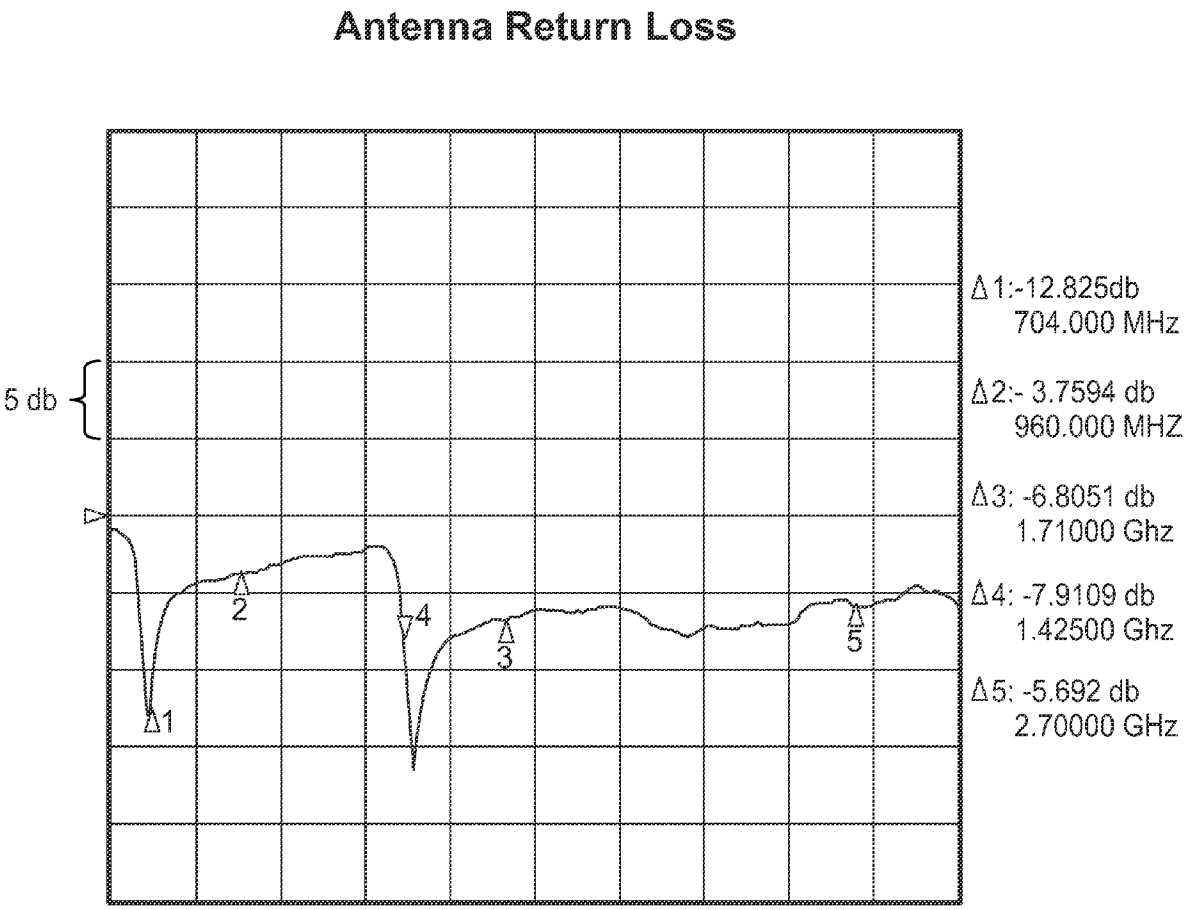
FIG. 10 is a graph illustrating return loss of an antenna apparatus formed in accordance with an embodiment.

FIG. 10 is a graph illustrating return loss by an antenna apparatus that was formed in accordance with an embodiment. More specifically, an antenna apparatus, such as the antenna apparatus 210 (FIG. 2), was tested through a range of frequencies (600.00 MHz to 3 GHz). At 704 MHz, the return loss was 12.825 dB. At 960 MHz, the return loss was 3.7594 dB. At 1425 MHz, the return loss was 7.9109 dB. At 1710 MHz, the return loss was 6.8051 dB. At 2700 MHz, the return loss was 5.6962 dB. Accordingly, embodiments provide an antenna that is capable of performing effectively within multiple frequency bands.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An antenna apparatus comprising:

a system ground; and an antenna sub-assembly including a feed pad and a ground pad, the ground pad being electrically coupled to the system ground, the feed pad configured to be electrically coupled to a conductive pathway for communicating radio-frequency (RF) waves;

wherein the antenna sub-assembly includes a first level having a radiating trace that is electrically coupled to the feed pad, the radiating trace configured for communicating within a designated RF band, the antenna sub-assembly also including a second level that is stacked with respect to the first level, the second level including a reflector that is aligned with a portion of the radiating trace to reduce RF emissions therefrom.

2. The antenna apparatus of claim 1, wherein the reflector is positioned adjacent to the feed pad.

3. The antenna apparatus of claim 1, wherein the radiating trace includes multiple high-emission areas, the reflector being aligned with at least one of the high-emission areas to reduce RF emissions therefrom.

4. The antenna apparatus of claim 1, wherein the radiating trace has multiple branch segments, each of the branch segments configured for communicating within a different RF band.

5. The antenna apparatus of claim 1, wherein the antenna sub-assembly includes a director that is configured to re-direct RF emissions, the director being electrically coupled to the system ground.

6. The antenna apparatus of claim 5, wherein at least a portion of the director extends immediately adjacent to an edge of the antenna sub-assembly.

7. The antenna apparatus of claim 1, wherein the ground pad has a surface area that is less than a surface area of the radiating trace, wherein the system ground has a surface area that is significantly greater than the surface area of the ground pad and significantly greater than the surface area of the radiating trace.

8. A wireless communication device comprising:

first and second device sections having respective edges that are rotatably coupled to each other; and the antenna apparatus of claim 1 positioned within the first device section.

9. The wireless communication device of claim 8, further comprising power-control circuit and a proximity sensor, the proximity sensor configured to detect when a body of an individual is near the antenna apparatus, the power-control circuit configured to reduce power to the antenna apparatus based on signals from the proximity sensor.

10. The wireless communication device of claim 9, wherein the wireless communication device is a portable computer that is configured to be converted from a computer mode to a tablet mode, wherein the power-control circuit is configured to control the power based on whether the portable computer is in the computer mode or the tablet mode.

11. The wireless communication device of claim 9, wherein the antenna sub-assembly includes a director that is configured to re-direct RF emissions, the director being electrically coupled to the system ground.

12. The wireless communication device of claim 11, wherein at least a portion of the director extends immediately adjacent to an edge of the antenna sub-assembly.

13. The wireless communication device of claim 9, wherein the ground pad has a surface area that is less than a surface area of the radiating trace, wherein the system ground has a surface area that is significantly greater than the surface area of the ground pad and significantly greater than the surface area of the radiating trace.

14. An antenna apparatus comprising:

a system ground; and an antenna sub-assembly including a feed pad and a ground pad, the ground pad being electrically coupled to the system ground, the feed pad configured to be electrically coupled to a conductive pathway for communicating radio-frequency (RF) waves;

wherein the antenna sub-assembly includes a first level having a radiating trace that is electrically coupled to the feed pad, the radiating trace configured for communicating within a designated RF band, the antenna sub-assembly also including a second level that is stacked with respect to the first level, the second level including a director that is electrically coupled to the system ground and is configured to re-direct emitted RF emissions.

15. The antenna apparatus of claim 14, wherein at least a portion of the director extends immediately adjacent to an edge of the antenna sub-assembly.

16. The antenna apparatus of claim 14, wherein the antenna sub-assembly includes a parasitic trace that is coplanar with the radiating trace and extends parallel to the radiating trace for a designated distance.

17. The antenna apparatus of claim 14, wherein the second level includes a reflector that is aligned with a portion of the radiating trace to reduce RF emissions therefrom.

18. The antenna apparatus of claim 17, wherein the radiating trace includes multiple high-emission areas, the reflector being aligned with at least one of the high-emission areas.

19. The antenna apparatus of claim 14, wherein the radiating trace has multiple branch segments, each of the branch segments configured for communicating within a different RF band.

20. The antenna apparatus of claim 19, wherein the director extends proximate to an edge of the parasitic trace.

* * * * *